US007144617B2

(12) United States Patent
Schilling et al.

(10) Patent No.: US 7,144,617 B2
(45) Date of Patent: Dec. 5, 2006

(54) DIFFRACTIVE SECURITY ELEMENT

(75) Inventors: Andreas Schilling, Hagendorn (CH); Wayne Robert Tompkin, Baden (CH)

(73) Assignee: OVD Kinegram AG, Zuq (CH)

( * ) Notice: Subject to any disclaimer, the term of this patent is extended or adjusted under 35 U.S.C. 154(b) by 267 days.

(21) Appl. No.: 10/476,994

(22) PCT Filed: May 31, 2002

(86) PCT No.: PCT/EP02/05984

§ 371 (c)(1),
(2), (4) Date: Nov. 5, 2003

(87) PCT Pub. No.: WO02/100653

PCT Pub. Date: Dec. 19, 2002

(65) Prior Publication Data

US 2004/0135365 A1 Jul. 15, 2004

(30) Foreign Application Priority Data

Jun. 8, 2001 (DE) ..... 101 27 981

(51) Int. Cl.
*B41M 5/00* (2006.01)

(52) U.S. Cl. ..... 428/195.1; 428/209; 428/138; 428/141; 428/457; 428/42.1; 428/204; 428/207; 428/201; 428/312.8; 283/72; 283/82; 283/83

(58) Field of Classification Search ..... 428/195.1, 428/411.1, 41.8, 41.7, 357, 209, 138, 141, 428/457, 42.1, 204, 207, 201, 312.8; 283/80, 283/72, 82, 83

See application file for complete search history.

(56) References Cited

U.S. PATENT DOCUMENTS 4,277,514 A 7/1981 Sugiura et al.

(Continued)

FOREIGN PATENT DOCUMENTS

CA 2319137 A1 * 7/1999

(Continued)

OTHER PUBLICATIONS

Wright & Pitt, "Wavelength Discrimination," 1934.

*Primary Examiner*—Rena Dye
*Assistant Examiner*—Tamra L. Dicus
(74) *Attorney, Agent, or Firm*—Hoffmann & Baron, LLP

(57) ABSTRACT

A security element (2) comprising a reflective, optically variable surface pattern (3) which is embedded in a layer composite of plastic material and which can be visually recognized from predetermined observation directions is formed from a mosaic of optically active surface elements (13). In the mosaic of the surface pattern (3) at least two of the mosaic surfaces (11; 12) of the surface pattern (3) are arranged substantially adjacent and have microscopically fine light-diffractive relief structures (4). The spatial frequencies of the relief structures in the mosaic surfaces (11; 12) are of values from predetermined spatial frequency ranges in such a way that, in the case of illumination beams which are incident obliquely relative to a normal onto the plane of the layer composite, the relief structures of the mosaic surfaces (11; 12) deflect visible monochromatic light parallel to the normal (32). The relief structures of the mosaic surfaces (11; 12) differ only in respect of spatial frequency, the difference in the spatial frequencies in the adjacent mosaic surfaces (11; 12) being at most 40 lines/mm.

17 Claims, 2 Drawing Sheets

U.S. PATENT DOCUMENTS

| | | | | | |
|---|---|---|---|---|---|
| 4,522,429 | A | | 6/1985 | Gardner et al. | |
| 4,568,141 | A | | 2/1986 | Antes | |
| 4,589,686 | A | * | 5/1986 | McGrew | 283/85 |
| 4,717,221 | A | * | 1/1988 | McGrew | 283/15 |
| 5,014,471 | A | * | 5/1991 | Antes et al. | 156/233 |
| 5,032,003 | A | | 7/1991 | Antes | |
| 5,101,184 | A | * | 3/1992 | Antes | 235/454 |
| 5,158,845 | A | * | 10/1992 | Waitts et al. | 430/1 |
| 5,447,335 | A | * | 9/1995 | Haslop | 283/91 |
| 5,714,231 | A | * | 2/1998 | Reinhart | 428/156 |
| 5,737,886 | A | | 4/1998 | Kruckemeyer | |
| 5,757,521 | A | * | 5/1998 | Walters et al. | 359/2 |
| 5,772,248 | A | * | 6/1998 | Phillips | 283/91 |
| 5,830,609 | A | * | 11/1998 | Warner et al. | 430/10 |
| 5,912,767 | A | * | 6/1999 | Lee | 359/567 |
| 6,417,968 | B1 | * | 7/2002 | Staub et al. | 359/567 |

FOREIGN PATENT DOCUMENTS

| | | | | |
|---|---|---|---|---|
| EP | 0 105 099 | A1 | | 4/1984 |
| EP | 0194042 | A2 | * | 9/1986 |
| EP | 0 201 323 | B1 | | 11/1986 |
| EP | 0 281 350 | A1 | | 9/1988 |
| EP | 0 330 738 | A1 | | 9/1989 |
| EP | 0 375 833 | A1 | | 7/1990 |
| EP | 0 883 085 | A1 | | 12/1998 |
| JP | 09 220 892 | | | 8/1997 |
| JP | 10 332 916 | | | 12/1998 |

* cited by examiner

DIFFRACTIVE SECURITY ELEMENT

This application claims priority based on an International Application filed under the Patent Cooperation Treaty, PCT/EP02/05984, filed on May 31, 2002, and German Patent Application No. 101 27 981.7, filed on Jun. 8, 2001.

BACKGROUND OF THE INVENTION

The invention relates to a diffractive security element as set forth in the classifying portion of claim 1.

Such diffractive security elements are used for verifying the authenticity of a document and are distinguished by an optically variable pattern which changes in a striking and predetermined fashion from the point of view of the person observing it by virtue of rotation or tilting movement.

Diffractive security elements of that kind are known from many sources, reference is made here as representative examples to EP 0 105 099 B1, EP 0 330 738 B1 and EP 0 375 833 B1. They are distinguished by the brilliance of the patterns and the movement effect in the pattern, they are embedded in a thin laminate of plastic material and they are glued in the form of a stamp onto documents such as bank notes, bonds, personal identity papers, passports, visas, identity cards as set forth. Materials which can be used for production of the security elements are summarized in EP 0 201 323 B1.

Modern color photocopiers and scanner devices are capable of duplicating such a document in apparently true colors. The diffractive security elements are also copied, in which case admittedly the brilliance and the movement effect are lost so that the pattern which is visible in the original at a single predetermined angle of view is reproduced as an image with the printing colors of the color photocopier. Such copies of documents can be confused with the original under poor lighting conditions or if the observer is not paying attention.

When dealing with colored surface portions which are arranged in side-by-side relationship the human eye perceives a color contrast if the wavelengths of the spectral colors in the surface portions differ by fewer than ten nanometers (nm). Particularly in the range of between 470 nm and 640 nm an observer still notices differences of between 1 nm and 2 nm (W. D. Wright & F. G. G Pitt "Hue discrimination in normal colour vision", Proc. Physical Society (London) Vol. 46, page 459 (1934)).

A known idea, which is based on the differences in spectral sensitivity of the human eye and the color photocopier, is that of providing documents with a colored background and printing the information on the background in a different color, in which case the information, in relation to the background, involves a contrast which is perceptible by the human eye but which cannot reproduced by the color photocopiers.

EP 0 281 350 B1 discloses such a colored security paper which as a background has a repetitive, for example check, pattern consisting of two colors A and B, wherein the information is printed onto the background pattern, in a further color S. The spectral reflectivities of the colors A, B and S are so selected that the color photocopier can admittedly recognize and reproduce a contrast between A and S in regions of the color A, but not between B and S in regions of the color B. Therefore, of the information, only the parts which are in the regions A are visible on the copy.

U.S. Pat. No. 5,338,066 discloses two methods of distinguishing a colored original produced by a printing procedure from its colored copy. The one method detects color constituents of the printing ink and the other method is based on the different dynamic regions in image processing of the color photocopier compared with image processing of the human eye. In the original, the colors of the background and the information involve a modulation of ±5% in respect of their spectral reflectivity, wherein the background color has the maximum in the green spectral range of visible light and the color for the information has respective maxima in the blue and red spectral ranges. The spectral reflectivities of both complementary colors are of the same value, averaged over the visible spectral range, and together form the color white. While the eye can easily perceive the crimson information against the green background the color photocopier only registers a white to slightly gray surface.

The reference to additional chemical detection for detecting the authenticity of an assumed original involves the technique of color mixing, which in practice is difficult to manage.

SUMMARY OF THE INVENTION

The object of the present invention is to provide an inexpensive diffractive security element which has information which cannot be reproduced by a color photocopier.

In accordance with the invention the specified object is attained by the features recited in the characterizing portion of claim 1. Advantageous configurations of the invention are set forth in the appendant claims.

BRIEF DESCRIPTION OF THE DRAWINGS

Embodiments of the invention are described in greater detail hereinafter and illustrated in the drawing in which.

DESCRIPTION OF THE PREFERRED EMBODIMENTS

Figure 1:
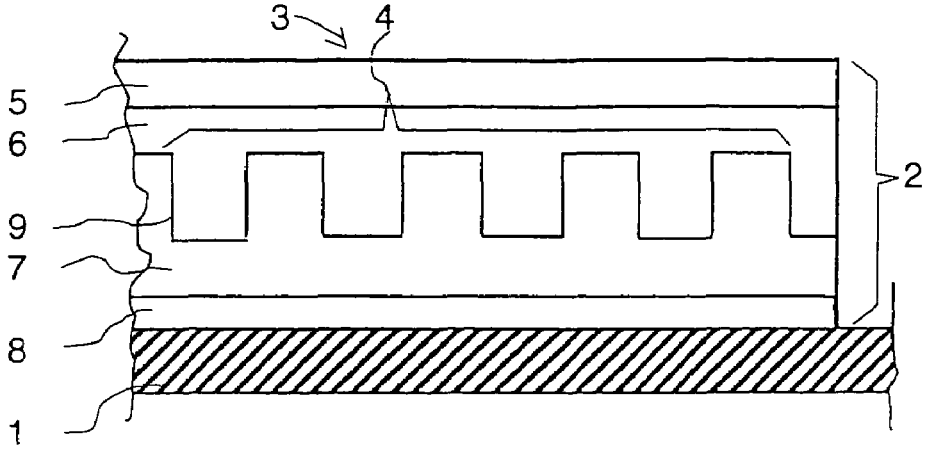
FIG. 1 is a view in cross-section through a relief structure.

FIG. 1 is a view in cross-section of a security element 2 which is glued onto a document 1 and which has a surface pattern 3. The documents 1 mean in particular passes, banknotes, visas, bonds, entrance cards and so forth, which serve as a substrate for the security element 2 and the authenticity of which is verified by the security element 2 which is stuck thereon. The microscopically fine, mechanically or holographically produced, optically active structures 4 of the surface pattern 3 are embedded in a layer composite of plastic material. For example the layer composite comprises a transparent cover layer 5 which is as clear as glass and through which the surface pattern 3 can be visually recognized from predetermined observation directions. Arranged beneath the cover layer 5 is a lacquer layer 6 in which the microscopically fine structure 4 is formed. The structure 4 is only symbolically shown in the form of a simple rectangular structure and stands for a mosaic of the surface pattern 3 consisting of the optically active structures 4 of surface elements. The structure 4 is covered over with a protective lacquer layer 7 in such a way that grooves of the structures 4 are filled by the protective lacquer layer 7 and the structure 4 is embedded between the lacquer layer 6 and the protective lacquer layer 7. An adhesive layer 8 is disposed between the document 1 and the protective lacquer layer 7 so that the security element 2 can be fixedly connected to the document 1. In other design configurations the layers 5 and 6, and 7 and 8 respectively, can be of the same material so that there is no interface between the layers 5 and 6, and 7 and 8 respectively. The structure 4 defines an interface 9 between the layers 6 and 7. The optical effectiveness of the interface 9 increases with the difference in the refractive indices of the materials in the two adjoining layers, the lacquer layer 6 and the protective lacquer layer 7. To increase the optical effectiveness of the interface 9, the structure 4, prior to application of the protective lacquer layer 7, is covered with a metallic or dielectric reflection layer which is thin in comparison with the depths of the grooves. Other embodiments of the security element 2 and the materials which can be used for the transparent or non-transparent security elements are described in EP 0 201 323 B1 to which reference is made in the opening part of this specification. The structure 4 shown in FIG. 1 is only symbolically illustrated in the form of a simple rectangular structure and stands for general, optically active structures 4 such as light-diffractive relief structures, light-scattering relief structures or mirror surfaces. Known light-diffractive relief structures are linear or circular diffraction gratings and holograms. Matt structures are also embraced by the term light-scattering relief structures.

Figure 2:
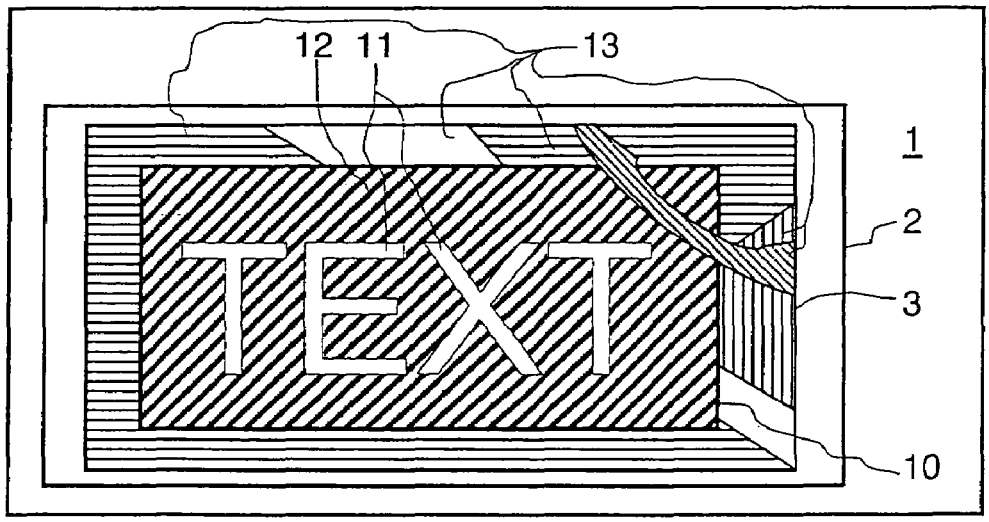
FIG. 2 shows a surface pattern.

FIG. 2 shows the security element 2 which is mounted on the document 1 and which has a text panel 10. The text panel 10 is part of a diffractive surface pattern 3. In a simple design, the text panel 10 has at least two mutually adjoining mosaic surfaces 11, 12. In other embodiments, the mosaic surfaces 11, 12 form a pattern with a background surface 12 and surface portions 11. The surfaces of the background surface 12 and of the surface portions 11 are covered with diffraction structures. Further surface elements 13 which are arranged in a mosaic-like fashion and which have a diffractive, scattering or reflective property supplement the surface pattern 3. Individual strip-shaped surface elements 13 can also extend over the text panel 10.

By way of example the text panel 10 has an inscription "TEXT". The inscription comprises the surface portions -11 which are arranged within at least one background surface 12. Incident white light is so diffracted at the diffraction structures that both the background surface 12 and also the surface portions 11 appear to an observer under predetermined viewing conditions in predetermined colors, and the surface portions 11 stand out from the background surface 12 by a color contrast.

Figure 3:
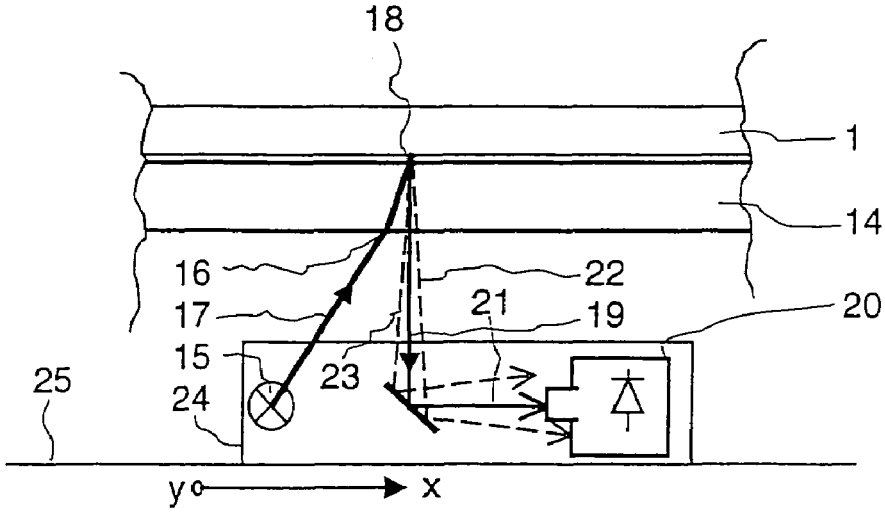
FIG. 3 shows a view in cross-section through a scanning apparatus of a color photocopier.

FIG. 3 shows a diagrammatic view in cross-section through a scanning apparatus of a color photocopier. A glass plate 14 serves as the support for the document 1 to be copied, with the security element 2 glued thereon (FIG. 1). The document 1 is in contact with the glass plate 14, with the surface of the document that is to be copied. A white light source 15 illuminates a narrow strip 16 on the glass plate 1, in this view the strip 16 extending in the direction y perpendicularly to the plane of the drawing in FIG. 3 and therefore being visible in the drawing only in the form of a point. A direction x is directed parallel to the plane of the drawing in FIG. 3 and to the surface of the glass plate 14. An illumination beam 17 from the white light source 15 is refracted by the glass plate 14 towards the perpendicular in such a way that the illumination beam 17 is incident at an angle of about 30° onto the surface of the document 1 and onto the diffraction structure and lights up a region 18 of the document 1, that is parallel to the strip 16. In the region 18 the light is reflected, diffracted by the diffraction structure, and scattered or reflected at the surface of the document 1. A part of the diffracted, reflected or scattered light again passes through the glass plate 14 and is sent back into the half-space above the glass plate 14. Only light beams 19 which pass perpendicularly through the glass plate 14 pass directly or by way of a deflection mirror in the form of deflected lights beams 21 into a light receiver 20. All other light, for example secondary beams 22, 23, which does not pass perpendicularly through the glass plate 14, is incident on screening members (not shown here) and does not pass into the light receiver 20. The white light source 15 and the light receiver 20 are arranged on a carriage 24 which is displaceable on rails 25 for optically scanning the document 1 in the direction x. The white light source 15, the deflection mirror, the light receiver 20 and the carriage 24 extend linearly in parallel relationship with the strip 16 in the y-direction. The drawing does not show the optical system of the light receiver 20 for guiding the light beams 19, 21 between the region 18 and the light receiver 20. In the scanning operation the region 18 moves stepwise over the document 1 in such a way that the color photocopier detects one strip-image of the document 1 or the security element 2 after the other. The entire substrate 10 is optically scanned stepwise.

Figure 4:
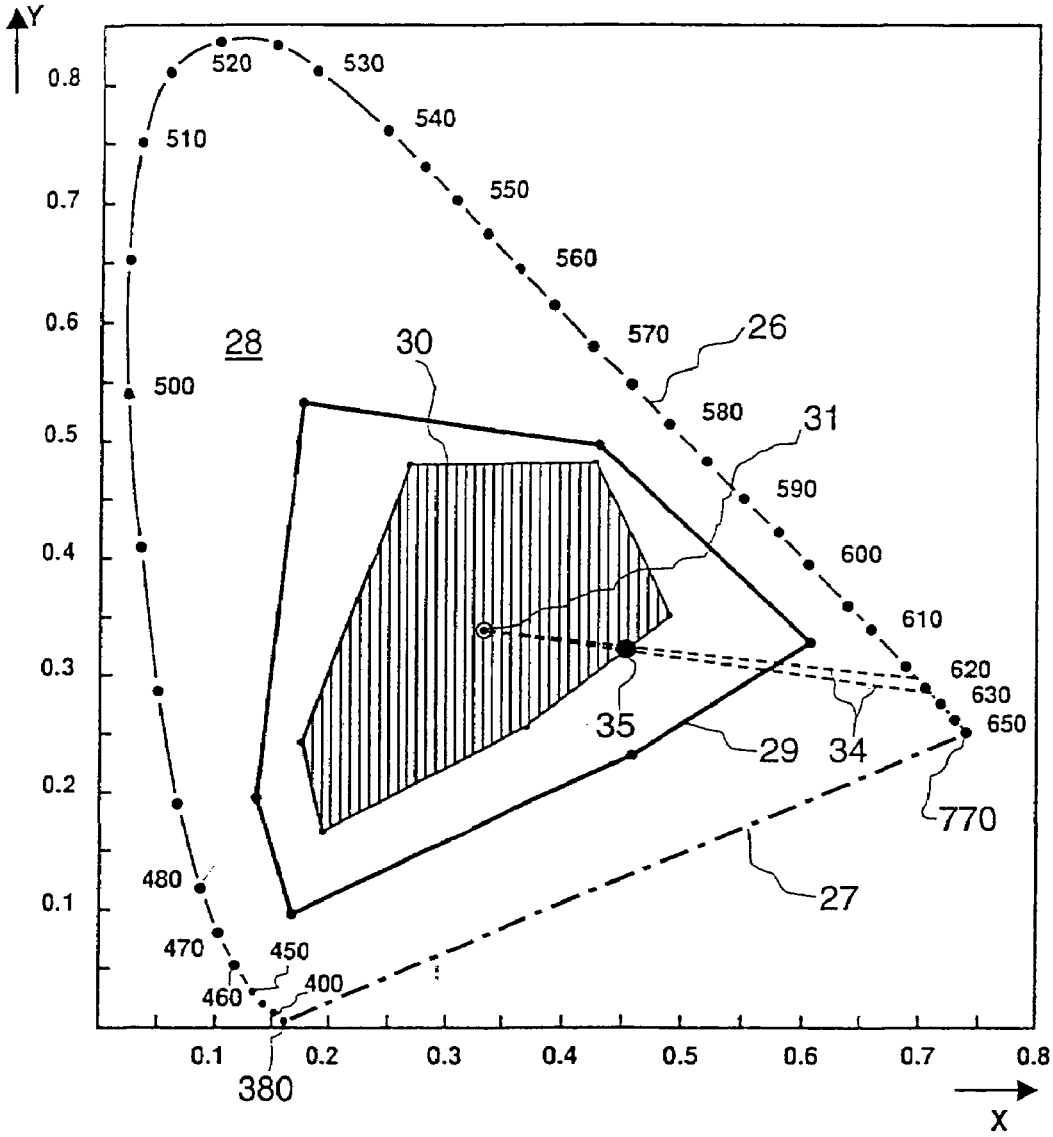
FIG. 4 shows a color diagram.

FIG. 4 shows a color diagram (from "Optical Document Security", van Renesse, Editor, ISDN Number 0-89006-982-4, page 135). Locations of spectrally pure colors form the outer tongue-shaped boundary 26. The three-digit numbers along the boundary 26 specify the wavelength of the light in nanometers (nm). The straight connecting line 27 between 380 nm and 770 nm is the location of the crimson colors. All mixed colors are in the color region 28 within the boundary 26 and the connecting line 27. The polygon 29 which is in the color region 28 embraces the region of color reproduction of high-grade color printing machines and the inner, polygonal, hatched color value region 30 with the white spot 31 is reproduced by color photocopiers. If the colors of the document 1 are printed with the color printing machine, the color values lie within the polygon 29. The color photocopier with the color value region 30 limits the colors reproduced in the copy of the document 1 as they are all associated with the color value region 30. A color value which is outside the color value region 30, for example on a line 34 within the color region 28, is reproduced in the color copy as a colored spot 35. The colored spot 35 is on the line 34 connecting the location of the color value and the white spot 31.

Going back now to FIG. 2: the illustrated text panel 10 with its microscopically fine, mechanically or holographically produced, optically active structures 4 (FIG. 1), upon illumination with white light (daylight), produces from the point of view of the observer almost spectrally pure colors which are on the boundary 26 (FIG. 4). When the text panel 10 is copied, under the lighting conditions obtaining in the color photocopier and in accordance with the parameters of the illuminated diffraction structures, in the background surface 12 and/or in the surface portions 11, light with an almost spectrally pure color is registered in the light receiver 20 (FIG. 3). In the copy the color photocopier reproduces the text panel 10 with the color values available to it from the color value region 30. The surface pattern 3 (FIG. 2) is reproduced under the scanning and lighting conditions in the color photocopier in the pattern registered for the light receiver 20 with the colors from the color value region 30, in the color copy. Reproduction of the surface pattern 3 in the color copy is therefore also dependent on the scanning direction.

In accordance with the invention, the spatial frequencies $f_H$ and $f_T$ are so selected for the background surface 12 and for the surface portions 11 respectively, that the eye of the observer detects a color contrast between the background surface 12 and the surface portions 11 and can distinguish the surface portions 11 from the background surface 12. Therefore the observer recognizes in the original of the security element 2 the information represented by the surface portions 11. If the spatial frequencies $f_H$ and $f_T$ are closely adjacent, the color photocopier reproduces both the background surface 12 and also the surface portions 11, in the same color value. The background surface 12 and the surface portions 11 are therefore indistinguishable in the copy. The items of information represented with the surface portions 11 are alphanumeric characters, as shown in FIG. 2, and/or graphic patterns or characters.

Figure 5:
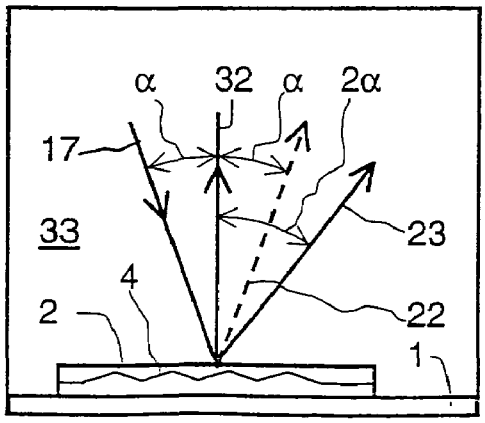
FIG. 5 shows a diffraction plane.

FIG. 5 shows the illumination and observation conditions in the color photocopier. The security element 2 with the optically active structure 4 is disposed in the x-y-plane of the document 1. If the structure 4 is a mirror surface which is flat in the x-y-plane, the illumination beam 17 which is incident obliquely at an angle $-\alpha$ is reflected at the angle $+\alpha$ relative to the normal 32, in the form of a secondary beam 22. The flat mirror surface is therefore registered by the color photocopier as a black surface. The illumination beam 17, the secondary beam 22 and the normal 32 define a diffraction plane 33.

If the optically active structure 4 is for example a linear diffraction grating 40 (FIG. 6), the light beam 19 which is diffracted into the negative k-th diffraction order (FIG. 3) is only incident in the light receiver 20 (FIG. 3) if the light beam 19 is diffracted parallel to the normal 32. The spatial frequencies f and $f_H$ and $f_T$ respectively are therefore predetermined in accordance with the following equation:

$$\sin(\delta=0°)-\sin(\alpha)=\pm k\cdot\lambda\cdot f$$

wherein $\alpha$ is the angle of incidence and $\delta=0°$ is the diffraction angle between the normal 32 and the diffracted light beam 19. The diffracted light beam 19 is at the wavelength $\lambda$ in the k-th diffraction order. The beam diffracted at the positive k-th diffraction order, the secondary beam 23, includes the angle $2\alpha$ relative to the normal 32. For an angle of incidence $\alpha$ of between 25° and 30° and with k=1 the usable range of the spatial frequencies f is between 725 lines/mm and 1025 lines/mm; with k=2 the usable spatial frequencies f are between 350 lines/mm and 550 lines/mm so that the diffracted light goes to the light receiver 20. The range limits are determined by the optical system, the geometry and the color sensitivity of the light receiver 20. In order to compensate for unevenness that is possibly present in the surface pattern 3, it is advantageous to modulate the spatial frequency f, in which respect the spatial frequency f changes over at least a part of a period or over a plurality of periods between 0.5 mm and 10.0 mm with a variation of between 3 lines/mm and 20 lines/mm. That modulation is visible with the naked eye in daylight but it cannot reproduced by the color photocopier. In an embodiment, two mosaic surfaces 11 and 12 having the spatial frequencies $f_H$ and $f_T$ meet each other, wherein along the common boundary of the two mosaic surfaces 11 and 12 the modulation of the spatial frequencies $f_H$ and $f_T$ is displaced by a phase angle, for example in the range of between 90° and 180°.

That consideration applies only as long as the grating vector of the diffraction grating is in the diffraction plane 33 and thus parallel to the scanning direction. The grating vectors of the diffraction gratings in the background surface 12 (FIG. 2) and in the surface portions 11 (FIG. 2) are therefore arranged substantially parallel so that the diffraction gratings in the background surface 12 and in the surface portions 11, in contrast to the rest of the surface pattern 3 (FIG. 2) are optically scanned substantially under identical conditions.

With any scanning direction, the grating vector has an azimuth $\theta$ with respect to the diffraction plane 33. The effective spatial frequency f decreases in the case of a linear diffraction grating with increasing azimuth $\theta$ so that the spectral color produced by the diffraction grating in the direction of the normal 32 alters both in the background surface 12 and also in the surface portions 11, in which case the difference in the wavelengths of the diffracted light beams 19 from the background surface 12 and from the surface portions 11 scarcely changes and the color photocopier does not reproduce the slight color differences.

As soon as visible diffracted light beams 19 no longer pass into the light receiver 20, the light receiver 20 only still receives scatter light; the diffraction grating, irrespective of its spatial frequency f, acts like a dark matt structure and is reproduced by the color photocopier in a gray color. Reproduction of the document 1 (FIG. 2) with the security element 2 with the optical-diffraction surface pattern 3 depends on the orientation of the surface pattern 3 on the glass plate 18 (FIG. 18), wherein the text panel 10 is always reproduced in one color so that the information contained in the surface portions 11 cannot be identified.

The spatial frequencies for the diffraction gratings of the background surface 12 and the surface portions 11 are advantageously so selected that, upon scanning of the surface pattern 3 with the white illumination beam 17 (FIG. 3), light of the wavelength $\lambda$ in the range of between 615 nm and 700 nm passes into the light receiver 25 (FIG. 3). The spatial frequencies $f_H$ and $f_T$ respectively are therefore to be selected from the spatial frequency range of between 770 lines/mm and 820 lines/mm, wherein the spatial frequencies $f_H$, $f_T$ involve a spatial frequency difference $\Delta f=\pm(f_H-f_T)$ of between 5 lines/mm and 40 lines/mm for k=1 and 20 lines/mm for k=2, wherein k denotes the diffraction order. In an embodiment of the surface pattern 3 the diffraction grating of the background surface 12 is of the spatial frequency $f_H$=810 lines/mm and 860 lines/mm respectively and the diffraction gratings in the surface portions 11 involve the spatial frequency $f_T$=800n lines/mm and 890 lines/mm respectively. It will be appreciated that the values in respect of $f_H$ and $f_T$ are interchangeable. The background surface 12 with $f_H$=810 lines/mm lights up in a red of a wavelength of 617 nm in daylight from the point of view of the observer while the surface portions 11 with $f_T$=800 lines/mm appear in a dark red of 625 nm wavelength. In that range the human eye distinguishes a wavelength difference of at least 2 nm. From the point of view of the observer the difference of 8 nm produces a marked color contrast so that the information can be readily identified. The color photocopier is not in a position to reproduce that color difference in the copy.

Figure 6:
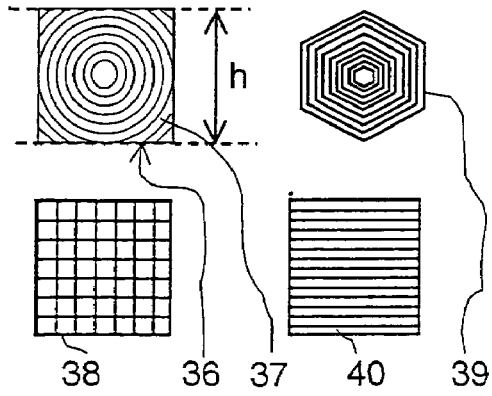
FIG. 6 shows a diffraction grating.

In order to reduce the dependency of reproduction of the text panel 10 (FIG. 2) in the colored copy on the scanning direction the diffraction gratings of the background surface 12 (FIG. 2) and the surface portions 11 (FIG. 2) are advantageously of the configurations which are shown in FIG. 6 and which differ only in respect of the spatial frequencies $f_H$ and $f_T$. The diffraction gratings fill square or hexagonal surface portions 36 with a largest dimension h of less than 0.3 mm. The surface portions 36 are of the same shape and the same size and completely fill the background surface 12 and the surface portions 11. In an embodiment, the mosaic surfaces 11, 12 are composed of the surface portions 36 involving the character of pixels. The shapes of the diffraction gratings filling the surface portions 36 are circular diffraction gratings 37, linear cross gratings 38, and hexagonal diffraction gratings 39. In the circular diffraction grating 37 circular grooves are arranged concentrically in the surface portion 36 with the spatial frequency f. The linear cross grating 38 has two or more crossed linear diffraction gratings, preferably at the same spatial frequency f. In the hexagonal diffraction grating 39 the grooves are of a hexagonal shape and are arranged concentrically in the surface portion 36, advantageously of hexagonal shape, involving the spatial frequency f. Instead of the hexagonal diffraction grating 39 it is possible to use groupings of linear diffraction gratings 40 with grating vectors which are distributed regularly in the azimuth; that grouping of the linear diffraction gratings 40 is a generalization of the hexagonal diffraction grating 39. The linear diffraction gratings 40 which were considered in the description relating to FIGS. 1 through 5 are also of advantage.

The invention claimed is:

1. A security element comprising a reflective, optically variable surface pattern which is embedded in a layer composite of plastic material and which is visually recognizable from predetermined observation directions, formed from a mosaic of optically active surface elements, wherein the mosaic surfaces comprise at least one surface portion and a background surface which are arranged substantially adjacent and are occupied with microscopically fine, light-diffractive relief structures having substantially parallel grating vectors, wherein a first spatial frequency of the relief structure of the background surface and a second spatial frequency of the relief structure of the at least one surface portion have different values which are selected from predetermined spatial frequency ranges such that for white light illumination beams which are obliquely incident onto a plane of the layer composite, the at least one surface portion and the background surface deflect monochromatic light beams of different wavelengths parallel to a normal to the plane, wherein a difference between the first spatial frequency and the second spatial frequency is in a range of between 5 lines/mm and 40 lines/mm, wherein the background surface surrounds the at least one surface portion to form an item of information which is visually recognizable with the naked eye viewing the security element by a color contrast but which is not visually recognizable to the naked eye viewing a color copy of the security element, the adjacent background surface and the at least one surface portion both being reproduced in the same color in the color copy.

2. A security element as set forth in claim 1, wherein at least one of the first spatial frequency and the second spatial frequency is modulated with a period of between 0.5 mm and 10 mm and a variation of between 3 lines/mm and 20 lines/mm.

3. A security element as set forth in claim 2, wherein the modulation of the first spatial frequency of the relief structure of the background surface is displaced through a phase angle selected from a range of between 60° and 180° with respect to the modulation of the second spatial frequency of the relief structure of the at least one surface portion.

4. A security element as set forth in claim 1, wherein the first spatial frequency and the second spatial frequency are in a range of between 350 lines/mm and 550 lines/mm or in a range of between 725 lines/mm and 1025 lines/mm.

5. A security element as set forth in claim 1, wherein the first spatial frequency and the second spatial frequency are in a range of between 800 lines/mm and 820 lines/mm and/or between 860 lines/mm and 890 lines/mm.

6. A security element as set forth in claim 1, wherein the adjacent background surface and at least one surface portion are in the form of words or alphanumeric characters or a graphic design.

7. A security element as set forth in claim 1, wherein the adjacent background surface and at least one surface portion are divided into a plurality of surface areas with a largest dimension of 0.3 mm and wherein the plurality of surface areas of the adjacent background surface and at least one surface portion have circular diffraction gratings or crossed linear diffraction gratings or hexagonal diffraction gratings as relief structures.

8. A security element as set forth in claim 1, wherein the adjacent background surface and at least one surface portion have linear diffraction gratings as relief structures.

9. A security element as set forth in claim 1, wherein the background surface and the at least one surface portion are divided into square or hexagonal shaped surface areas of the same shape and the same size which completely fill the background surface and the at least one surface portion, the surface areas having a largest dimension of 0.3 mm, and wherein the surface areas of the background surface and of the at least one surface portion have at least one of circular gratings or hexagonal gratings or linear gratings or crossed linear diffraction gratings as relief structures.

10. A security element as set forth in claim 7, wherein the adjacent background surface and the at least one surface portion include pixels of the item of information.

11. A security element as set forth in claim 1, wherein the white light illumination beams are incident at an angle of incidence in a range of between 25° and 30° relative to the normal.

12. A security element as set forth in claim 11, wherein the wavelength of the monochromatic light rays deflected parallel to the normal are in a range of 615 nm to 700 nm.

13. A security element as set forth in claim 11, wherein the wavelength of the monochromatic light rays deflected parallel to the normal by the background surface differ by 8 nm from the wavelength of the monochromatic light rays deflected by the at least one surface portion.

14. A security element as set forth in claim 1, wherein the first spatial frequency and the second spatial frequency are 800 lines/mm and 810 lines/mm, respectively, or 860 lines/mm and 890 lines/mm, respectively.

15. A security element as set forth in claim 1, wherein the same color is a gray color.

16. A security element as set forth in claim 1, wherein the first spatial frequency and the second spatial frequency are selected from a range of between 770 lines/mm and 820 lines/mm.

17. A security element as set forth in claim 9, wherein the adjacent background surface and at least one surface portion include pixels of the item of information.

* * * * *